428-408

10/5/82 XR 4,352,407

SR

United States Patent [19]

Tsukagoshi et al.

[11] 4,352,407

[45] Oct. 5, 1982

[54] DIAPHRAGMS FOR ACOUSTIC INSTRUMENTS AND METHOD OF PRODUCING THE SAME

[76] Inventors: Tsunehiro Tsukagoshi; Shinichi Yokozeki; Toshikazu Yoshino; Yasuyuki Arai, all c/o Pioneer Electronic Corporation Ohmori Factory, No. 4-15-5, Ohmori-nishi, Ohta-ku, Tokyo, Japan, 143

[21] Appl. No.: 78,045

[22] Filed: Sep. 24, 1979

[30] Foreign Application Priority Data

Sep. 29, 1978 [JP] Japan ..... 53-120283

[51] Int. Cl.[3] ..... G10K 13/00

[52] U.S. Cl. ..... 181/167; 428/338; 428/402; 428/408

[58] Field of Search ..... 181/167, 166, 168–170; 260/42.17; 428/402, 403, 408, 367, 323, 338; 524/496

[56] References Cited

U.S. PATENT DOCUMENTS

| | | | |
|---|---|---|---|
| 2,308,305 | 1/1943 | Reynolds | 428/408 X |
| 3,404,061 | 10/1968 | Shane et al. | 428/408 X |
| 3,416,992 | 12/1968 | Amos | 428/408 |
| 4,221,773 | 9/1980 | Tsukagoshi et al. | 181/167 X |

FOREIGN PATENT DOCUMENTS

| | | | |
|---|---|---|---|
| 52-2723 | 1/1977 | Japan | 181/167 |

*Primary Examiner*—L. T. Hix
*Assistant Examiner*—Benjamin R. Fuller

[57] ABSTRACT

A diaphragm for acoustic instruments such as speakers is produced by blending and kneading a thermoplastic resin such as polyvinyl chloride resin with graphite powder, rolling the blend into a sheet until graphite particles are oriented, and forming the sheet into a desired diaphragm shape. The diaphragm of the composite material containing graphite particles oriented shows an improved combination of density, elasticity and internal loss.

13 Claims, 2 Drawing Figures

DIAPHRAGMS FOR ACOUSTIC INSTRUMENTS AND METHOD OF PRODUCING THE SAME

BACKGROUND OF THE INVENTION

This invention relates to diaphragms for use in acoustic instruments. More particularly, this invention relates to a diaphragm comprising a shaped body of a composite material consisting essentially of a thermoplastic resin such as polyvinyl chloride resin and graphite powder, and a method of producing the same.

Diaphragms for acoustic instruments, particularly diaphragms for speakers and microphones are required to have light weight, high rigidity and a high specific modulus of elasticity $E/\rho$, wherein E is Young's modulus and $\rho$ is the density, so that the diaphragms may efficiently reproduce acoustic signals over a wide frequency range with a high fidelity.

For this reason, wood pulp, plastics, aluminum, titanium and other materials have previously been used to form diaphragms. These materials, however, do not fully meet the above-mentioned requirements.

Synthetic resins have also been used in the manufacture of diaphragms. Examples include composite materials of carbon fiber and a synthetic resin. These composite materials, however, cannot provide sufficient rigidity when molded into a diaphragm shape partly because of insufficient integration of the resin attributable to the lubricating nature of the carbon fiber surface.

Boron, beryllium and carbon are known as having a high specific modulus. These materials have poor processing characteristics, which increase costs for molding them into diaphragms.

SUMMARY OF THE INVENTION

It is therefore an object of this invention to provide a diaphragm for acoustic instruments which comprises a composite material capable of being readily worked into a desired form as well as satisfying the requirements for diaphragms including light weight, high rigidity, high specific modulus and good internal loss.

It is another object of this invention to provide a method for producing a diaphragm for acoustic instruments from a composite material at low cost.

According to one aspect of this invention, a diaphragm for use in an acoustic instrument comprises a body formed of a composite material consisting essentially of a thermoplastic resin and graphite powder. Graphite powder particles should be substantially oriented in the body.

According to another aspect of this invention, a diaphragm is produced by blending and kneading a thermoplastic resin with graphite powder having a particle size of 0.1–50 microns, particularly 0.1–0.5 microns. The blend is rolled into a sheet which is then formed into a desired shape.

BRIEF DESCRIPTION OF THE DRAWINGS

The invention will be described in further detail by referring to the accompanying drawings wherein.

DESCRIPTION OF THE PREFERRED EMBODIMENTS

Considering that carbon has light weight, high rigidity, and a high specific modulus of elasticity $E/\rho$, the inventors proposed a diaphragm comprising a formed body of a carbonized or graphitized composite material consisting of an organic substance and carbon powder, typically graphite power (Copending Japanese Patent Application No. 52-154315 filed Dec. 23, 1977).

Carbonization or graphitization is used because diaphragms show a low specific modulus when they are molded from a blend of organic substances and graphite powder by compression forming or injection molding. By way of illustration, polyvinyl chloride was blended and kneaded with graphite powder at a varying blending ratio and the blends were compression formed into sheets having a thickness of 0.8 mm. The Young's modulus of these sheets was measured. The obtained values are plotted in relation to the blending ratio to give curve a in FIG. 2, wherein the Young's modulus is on the abscissa and the amount of graphite powder blended in the composite material (expressed in terms of percent by weight of the total composite material) is on the ordinate. Curve a shows that a maximum Young's modulus of about 3,000 kg/mm$^2$ is obtained when a blend of polyvinyl chloride and graphite is molded into a sheet without orientation. Curve b corresponds to the Young's modulus of similar sheets after being subjected to carbonization at 1,200° C. In this case, the maximum modulus reaches about 6,000 kg/mm$^2$. This increased Young's modulus corresponds to a specific modulus of elasticity of $5.7\times10^3$ m/sec which is higher than that of aluminum, but is still insufficient although various acoustic characteristics of the carbonized material are equal to or slightly superior to those of the prior art materials.

The inventors have found that orientation of graphite particles in a composite material of graphite and a thermoplastic resin improves the physical properties, particularly Young's modulus of the material.

The thermoplastic resin used herein is selected from the group consisting of polyvinyl chloride resins including polyvinyl chloride homopolymers and copolymers such as vinyl chloride-acrylonitrile and vinyl chloride-vinyl acetate copolymers; polyvinylidene chloride resins including polyvinylidene chloride homopolymers and copolymers such as vinylidene chloride-acrylonitrile copolymers; polycarbonate resins; and mixtures thereof. The amount of graphite powder to be added is 10–90 % by weight, preferably 30–80 % by weight of the total blend. Better results are obtained with a smaller size of graphite particles. The particle size of graphite is between 0.1 and about 50 microns, preferably between 0.1 and 5 microns.

Figure 1:
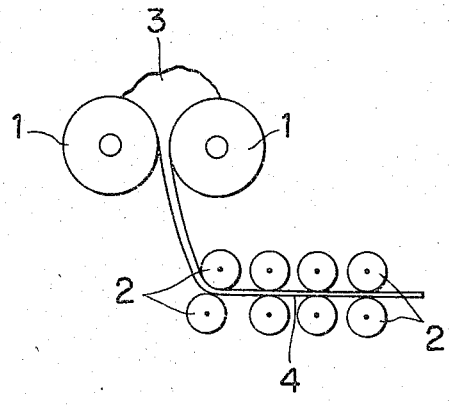
FIG. 1 is a schematic view showing an arrangement used for carrying out the present method.

FIG. 1 schematically shows a process of producing a diaphragm according to this invention. The illustrated arrangement includes a mixing mill 1 and a series of rollers 2. A thermoplastic resin, for example, a polyvinyl chloride resin is blended with graphite powder at a blending ratio of 1:2 (weight ratio) and the blend 3 is thoroughly kneaded by means of the mixing mill 1. During this kneading, the blend is heated to an elevated temperature above the softening point of the polyvinyl chloride resin, preferably to a temperature of 120°–250° C.

The kneaded material 3 is then rolled by means of the rollers 2 into a sheet 4 having a uniform thickness. Rolling is also performed at a temperature above the softening point of the resin, preferably at a temperature of 120°-250° C. By rolling the kneaded material into a sheet, graphite particles are oriented in parallel with the surface of the sheet. As a result, the longitudinal modulus of the sheet 4 is improved.

For the purpose of mixing and kneading the components, a mill followed by rollers is used in the illustrated embodiment. The same purpose can be achieved by extrusion molding. In this case, the resin and graphite are introduced into an extruder at an elevated temperature which serves to mix and knead the components. An extrudate is yielded from the extruder and then rolled into a sheet to orient the graphite particles.

For the purpose of imparting a substantial degree of orientation to graphite particles as well as forming the kneaded material into a sheet, rolling is contemplated in this invention. Rolling may advantageously be repeated because repeated rolling can further enhance the orientation of graphite particles in parallel with the surface of the sheet. The thickness of the rolled sheet depends on the final requirements such as the thickness, size and configuration of an intended diaphragm.

The sheet in which graphite particles are oriented is then formed into a dome or cone shape suitable for use as a diaphragm. Vacuum forming, thermal compression or pressure forming and other conventional methods may be employed for this purpose.

The rolled sheet shows a high longitudinal modulus since graphite particles are oriented in parallel with the surface of the sheet to a considerable extent. Rigid diaphragms may be prepared from such sheets.

Figure 2:
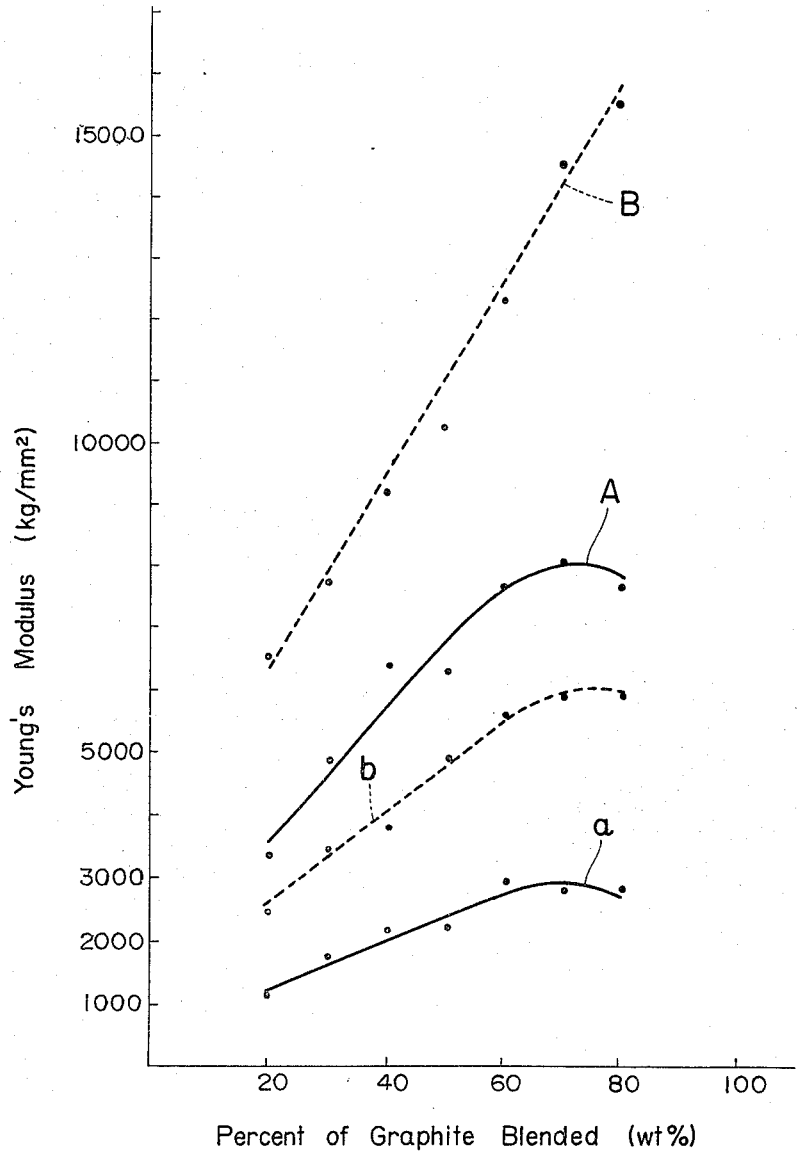
FIG. 2 is a graph showing Young's modulus for various composite materials relative to the graphite blending ratio.

The Young's modulus of rolled sheets having a varying graphite content is plotted as curve A in FIG. 2, which proves a doubled or more improvement in Young's modulus as compared with curve a of non-oriented sheets.

When the rolled sheets are further carbonized at a temperature of 500°-1200° C. or graphitized at a temperature of 2,000°-3,000° C., the Young's modulus is further increased as shown by curve B. However, the internal loss of the sheets is reduced.

The inventors have found that diaphragms prepared from oriented sheets are equal to or superior to those of carbonized or graphitized sheets from a point of view of commercial diaphragm production. First, the Young's modulus of oriented sheets reaches about 7,000-8,000 $kg/mm^2$ and hence, the specific modulus of elasticity is satisfactorily high. The internal loss expressed by tan $\delta$ typically approximates to 0.05 so that the undesired resonance peak may be suppressed. In the case of carbonized or graphitized sheets, the Young's modulus is increased to an extremely high level reaching about 15,000 $kg/mm^2$ whereas the internal loss is reduced to about 0.015. When a combination of Young's modulus and internal loss is considered, the oriented sheets are comparable to the carbonized or graphitized sheets.

Secondly, the method of producing a graphite oriented sheet is very simple because it only requires kneading and rolling. On the other hand, the carbonizing or graphitizing method is time consuming and expensive because the temperature must be increased to 1000°-2000° C. or more at a rate of 1°-20° C./hour and sometimes a pretreatment is also required.

A sample was prepared by blending and kneading polyvinyl chloride-polyvinyl acetate copolymer with graphite powder at a ratio of 3:7. The resulting intimate mixture was rolled into a sheet to achieve a substantial degree of orientation of graphite. The Young's modulus, density and internal loss of the rolled sheet were measured. For comparision, the sheet was then subjected to oxidation by heating it in an oxidizing atmosphere to about 250° C. at a rate of 1°-10° C./hour and thereafter subjected to carbonization by heating it in a non-oxidizing atmosphere to 1200° C. at a rate of 10°-20° C./hour. The Young's modulus, density and internal loss of the carbonized sheet were measured. The results are shown in the following Table.

TABLE

| | Density $\rho$ ($g/cm^3$) | Young's modulus E ($kg/mm^2$) | Specific modulus $\sqrt{E/\rho}$ (m/sec) | Internal loss tan$\delta$ |
|---|---|---|---|---|
| Rolled sheet | 1.8 | 8,000 | $6.60 \times 10^3$ | 0.05 |
| Carbonized sheet | 1.8 | 16,000 | $9.33 \times 10^3$ | 0.015 |
| Aluminum | 2.7 | 7,400 | $5.18 \times 10^3$ | 0.003 |
| Titanium | 4.4 | 12,000 | $5.17 \times 10^3$ | 0.003 |
| Beryllium | 1.8 | 28,000 | $12.35 \times 10^3$ | 0.003 |

In the Table, the physical properties of aluminum, titanium and beryllium are also involved. For specific modulus, the rolled or oriented sheet is superior to aluminum and titanium, but inferior to the carbonized sheet and beryllium. The internal loss of the rolled sheet is the highest of the other materials. Therefore the rolled sheet affords a desirable combination of specific modulus and internal loss required for acoustic diaphragms. Further, diaphragm manufacturing cost is minimized with the use of the rolled sheet of the composite material because the manufacturing process is very simple.

It has also been found that the diaphragm according to this invention shows an improved frequency response, particularly in a high frequency range. The frequency response to the present diaphragm is substantially equivalent to that of the beryllium diaphragm in the low and mid ranges and flatter in the high range.

What is claimed is:

1. An acoustic diaphragm formed of a homogeneous composite material consisting essentially of a thermoplastic resin selected from the group consisting of polyvinyl chloride, polyvinylidene chloride, polycarbonate resins and mixtures thereof; and graphite powder having a particle size of 0.1 to 50 microns being substantially parallel oriented in said diaphragm.

2. An acoustic diaphragm formed of a homogeneous composite material consisting essentially of a thermoplastic resin and graphite powder particles, the graphite powder particles being substantially parallel oriented in said diaphragm.

3. A diaphragm of claim 2 wherein said thermoplastic resin is selected from the group consisting of polyvinyl chloride, polyvinylidene chloride, polycarbonate resins and mixtures thereof.

4. A diaphragm of claim 3 wherein said thermoplastic resin is a vinyl chloride-vinyl acetate copolymer.

5. A diaphragm of claim 2 wherein the graphite has a particle size of 0.1 to 50 microns.

6. A diaphragm of claim 5 wherein the graphite has a particle size of 0.1 to 5 microns.

7. A diaphragm of claim 2 wherein said composite material includes 10 to 90 parts by weight of graphite powder and 90 to 10 parts by weight of the thermoplastic resin.

8. A diaphragm of claim 7 wherein said composite material includes 30 to 80 parts by weight of graphite powder and 70 to 20 parts by weight of the thermoplastic resin.

9. A diaphragm of claim 2 wherein said formed body is of a cone configuration.

10. A diaphragm of claim 2 wherein said formed body is of a dome configuration.

11. A diaphragm of claim 2, formed from a rolled composite sheet having a Young's modulus of about 7,000 to 8,000 kg/mm$^2$ and an internal loss of about 0.05.

12. A diaphragm of claim 2, formed from a rolled carbonized composite sheet having a Young's modulus of about 15,000 to 16,000 kg/mm$^2$ and an internal loss of about 0.015.

13. An acoustic diaphragm formed of a homogeneous composite material consisting essentially of a thermoplastic resin and graphite powder particles, the graphite powder particles being substantially parallel oriented in said diaphragm, and wherein said composite material has a Young's modulus of about 7000 to 16000 kg/mm$^2$ and an internal loss of about 0.05 to 0.015.

* * * * *